US005176354A

United States Patent [19]

Feigenbaum, Jr.

[11] Patent Number: 5,176,354

[45] Date of Patent: Jan. 5, 1993

[54] BLANKET ANCHOR

[76] Inventor: Virgil P. Feigenbaum, Jr., 305 Eric Ct., Woodstock, Ga. 30188

[21] Appl. No.: 867,322

[22] Filed: Apr. 13, 1992

[51] Int. Cl.[5] ..... A47B 97/00

[52] U.S. Cl. ..... 248/508; 135/118; 248/156

[58] Field of Search ..... 248/508, 545, 156; 52/155, 153; 135/118; 5/419

[56] References Cited

U.S. PATENT DOCUMENTS

| | | | |
|---|---|---|---|
| 1,854,671 | 4/1932 | Roberts | 52/155 X |
| 2,647,718 | 8/1953 | Disera | 248/508 |
| 2,939,468 | 6/1960 | Boyce | 135/118 |
| 3,241,202 | 3/1966 | Knauft | 135/118 X |
| 3,456,660 | 7/1967 | Borchardt | 135/118 |
| 4,914,767 | 4/1990 | Balicki | 5/419 |
| 4,927,118 | 5/1990 | Pierorazio | 135/118 X |
| 5,101,525 | 4/1972 | Ippolito | 135/118 X |

FOREIGN PATENT DOCUMENTS

| | | | |
|---|---|---|---|
| 1015922 | 8/1977 | Canada | 248/508 |

*Primary Examiner*—J. Franklin Foss

[57] ABSTRACT

A portable device for anchoring a blanket in sand or soft earth. In another aspect of the invention, the blanket anchor includes an adapter plug for receivably supporting a dispenser for a useful product (e.g., suntan lotion).

8 Claims, 5 Drawing Sheets

BLANKET ANCHOR

BACKGROUND OF THE INVENTION

1. Field of the Invention

The present invention generally relates to anchoring devices, and, more particularly, pertains to a portable device for anchoring a blanket in beach sand or soft earth.

2. Description of the Prior Art

Devices for anchoring beach blankets in beach sand or soft earth generally are known, but for one reason or another suffer from certain disadvantages. For example, U.S. Pat. No. Des. 262,514 discloses a multi-part device comprising a stake and an interfittable flat plate wedge in the shape of a heart for grasping the blanket between the bottom of the wedge and the top of the stake. Presumably, the stake is driven into the beach sand by applying might to the flat plate. Nonetheless, because of its multipart construction, this device is vulnerable to being misplaced and rendered inoperable and is expensive to fabricate.

Other solutions for maintaining a blanket relatively fixed on beach sand or soft earth comprise affixing various devices directly to the blanket per se. For example, U.S. Pat. No. 4,654,906 discloses a beach blanket with triangular-shaped corner pockets adapted to hold a quantity of sand therein. Similarly, U.S. Pat. No. 4,709,430 relates to a beach blanket having a tube sewn or otherwise contained in the border of the blanket. The tube is fitted with a liquid to provide weight means for maintaining the blanket relatively stationary on the beach sand or a lawn.

U.S. Pat. No. 3,903,626 discloses an auger having a pivotal head. In the horizontal position the head includes means for displaying a sign or other indicia and saves as a handle for screwing the auger into earth.

Finally, U.S. Pat. No. 4,185,424 shows a stake for use in indicating underground utility lines. The stake has a plurality of tapered webs disposed about its axis and an relatively small striking surface or head.

SUMMARY OF THE INVENTION

The present invention overcomes the disadvantages of the prior art by providing a blanket anchoring device that is simple in design and construction, inexpensive to fabricate, and easy to use. In one aspect, the anchoring device of the present invention comprises a tapered stake integrally joined to an elliptically shaped convex rounded head portion. The stake's centerline is offset relative to the central axis of the head portion to provide room for a gripper jaw set mounted to the flat underside of the head portion. The head portion is shaped and sized sufficiently so that the palm of a person's hand may comfortably and efficiently be used to apply weight to the stake, thereby driving the head portion and the stake into the beach sand or soft earth and securely anchoring same therein. A corner or other portion of the blanket being anchored may then be receivably engaged by the gripper jaw set to firmly anchor the blanket and maintain the blanket stationary on the beach sand or similar environment. In another aspect, the head has a circular shape, and the axis of the stake and the convex head portion are coincidental. In this alternative arrangement, the gripper jaw set extends radially outwardly from the head portion's periphery. A threaded aperture is disposed centrally within the convex head portion and is adapted to receive a male threaded adapter plug which, in turn, is adapted to receive the stem of a dispenser which latter may be used to dispense a useful product such as, for example, suntan lotion. In practice, a series of anchors according to the invention may be provided (e.g. four) to anchor a different corner or portion of the blanket being used in conjunction therewith.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least two embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which only is measured by the claims, nor is it intended to be limiting as to the scope of the invention in any way.

It is therefore an object of the present invention to provide a new and blanket anchor which has all the advantages of the prior art blanket anchors and none of the disadvantages.

It is another object of the present invention to provide a new and improved blanket anchor which may be easily and efficiently manufactured and marketed.

It is a further object of the present invention to provide a new and improved blanket anchor which is of a durable and reliable construction.

An even further object of the present invention is to provide a new and improved blanket anchor which is susceptible of a low cost of manufacture with regard to both materials and labor, and which accordingly is then susceptible of low prices of sale to the consuming public, thereby making such blanket anchors economically available to the buying public.

Still yet another object of the present invention is to provide a new and improved blanket anchor which provides in the apparatuses and methods of the prior art some of the advantages thereof, while simultaneously overcoming some of the disadvantages normally associated therewith.

Still another object of the present invention is to provide a new and improved blanket anchor which in one aspect is of one-piece construction.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

DESCRIPTION OF THE PREFERRED EMBODIMENT

With reference now to the drawings, a new and improved blanket anchor embodying the principles and concepts of the present invention will be described.

Figure 1:
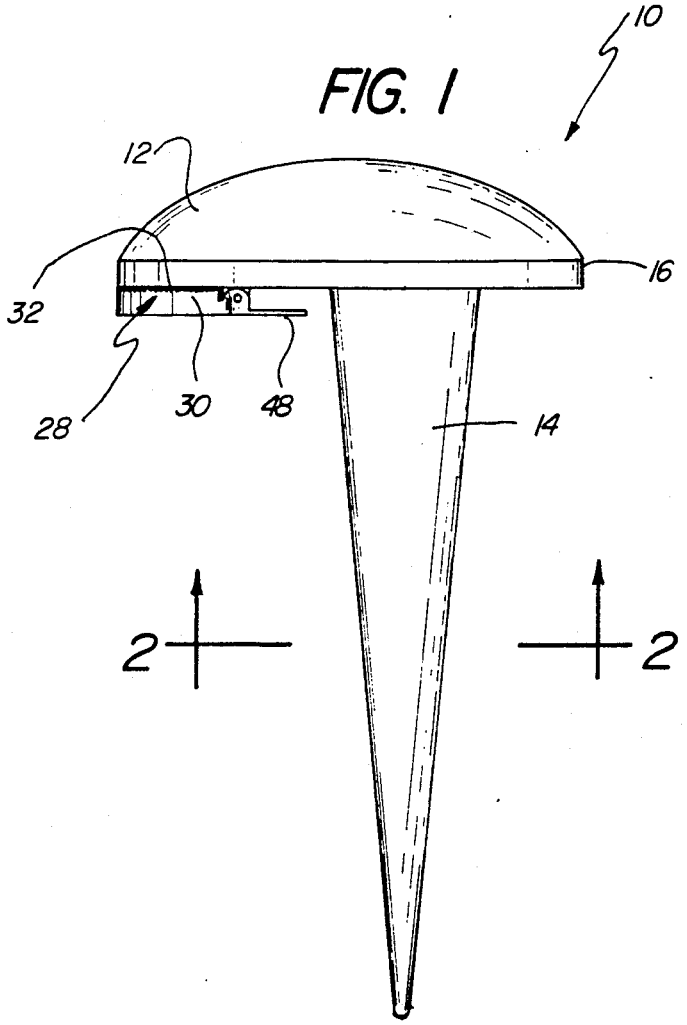
FIG. 1 is partial front elevational view of a blanket anchor according to the invention.
Figure 2:
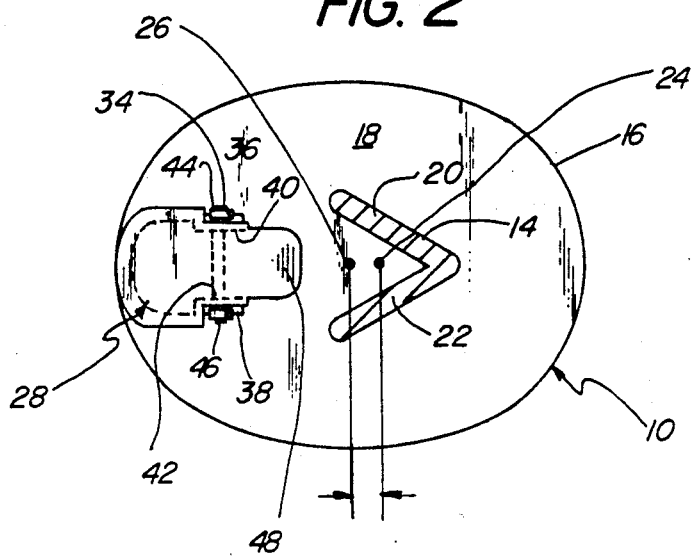
FIG. 2 is a cross-sectional view of the blanket anchor of FIG. 1 as viewed along the line 2—2 in FIG. 1.
Figure 3:
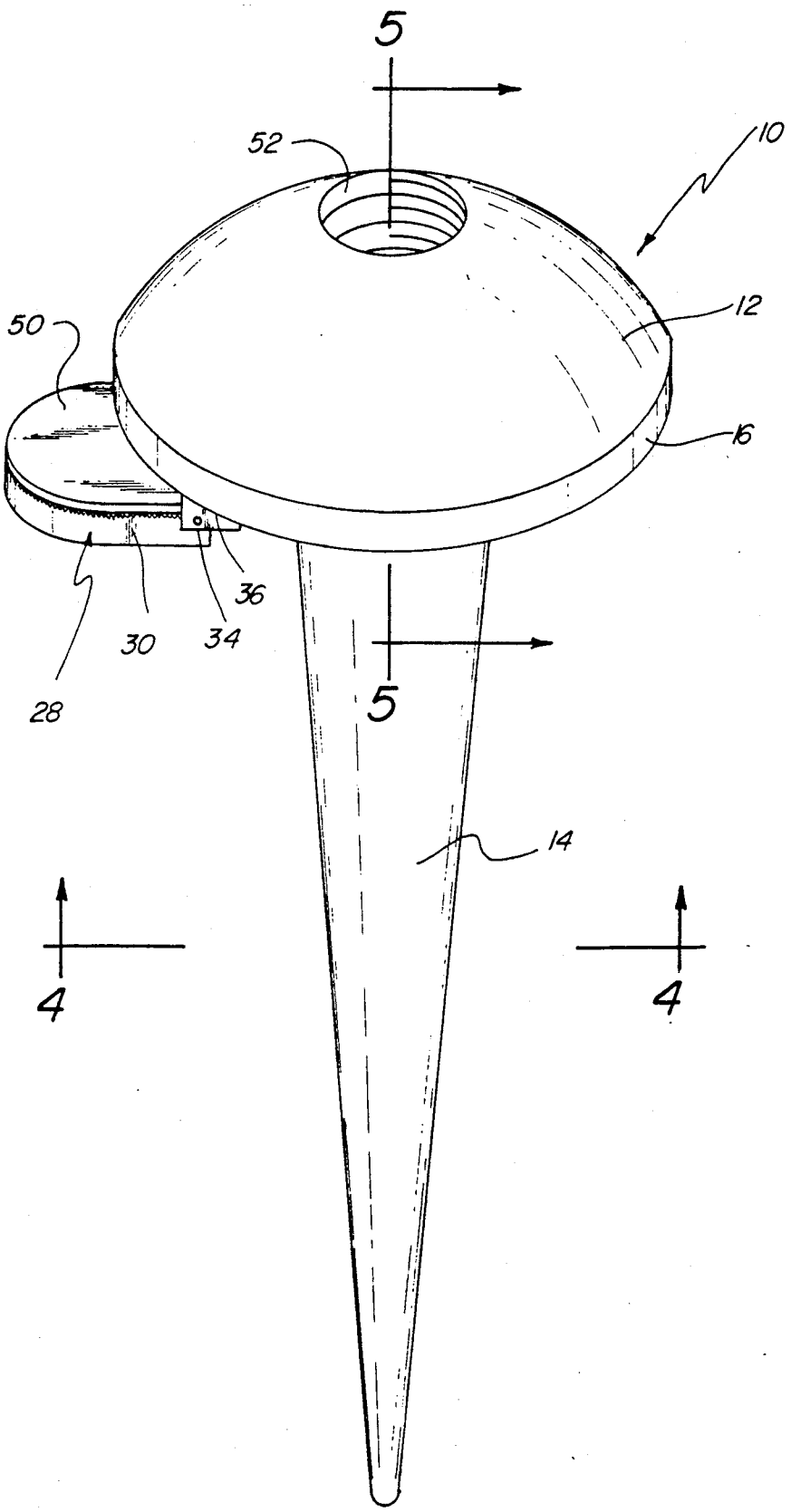
FIG. 3 is an isometric view of an alternative preferred embodiment of the blanket anchor of the present invention.
Figure 4:
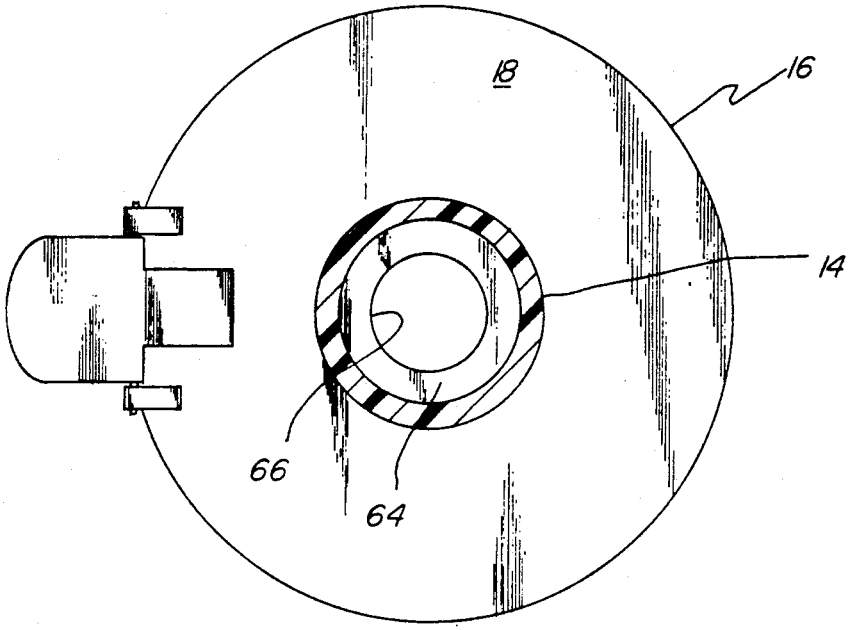
FIG. 4 is a cross-sectional view of the blanket anchor of FIG. 3 as viewed along the line 4—4 of FIG. 3.
Figure 5:
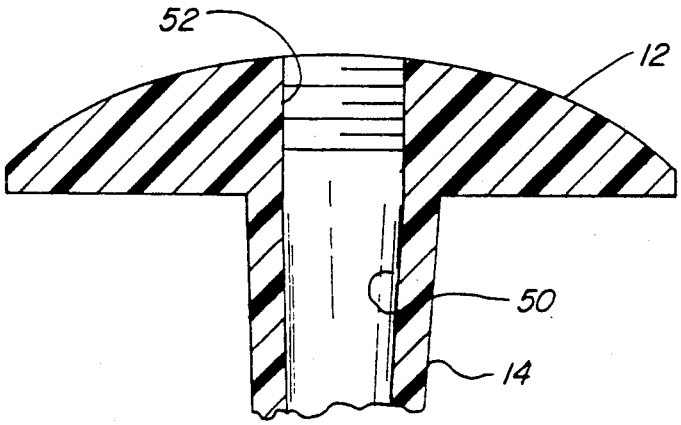
FIG. 5 is a cross-sectional view of the blanket anchor of FIG. 3 as viewed along the line 5—5 of FIG. 3.

Turning initially to FIGS. 1 and 2, there is shown a first preferred form of blanket anchor 10 according to the present invention comprising a rounded or convex head portion 12 integrally joined to a downwardly depending stake portion 14. As viewed in FIG. 2, head portion 12 has a generally elliptical shape and terminates at its periphery in an annular cylindrical surface 16. The underside of head portion 12 defines a flat surface 18 intercepted by the upper extremity of stake portion 14 substantially as illustrated.

Stake portion 14 is comprised of a pair of tapered, web sections 20 and 22 integrally joined to each other to define a V-shaped transverse cross-section substantially as shown in FIG. 2 with the preferred angle between web sections 20 and 22 being 45°. The width or span of the web section tapers downwardly as viewed in FIG. 1 from a maximum where the stake portion intercepts flat surface 18 to a minimum at the stake portion's distal extremity. By this arrangement, the distal extremity defines a relatively sharp point to facilitate driving the stake into beach sand, soft earth and the like.

Stake portion 14 is offset relative to head portion 12 as best seen in FIG. 2 by the lateral distance between the central axis 24 of stake portion 14 and the central axis 26 of head portion 12. The purpose of this offset is to provide room on the flat underside surface 18 for the mounting of an alligator clip or gripper jaw set generally designated by reference numeral 28. Alligator clip 28 comprises a pivotal jaw 30 generally of semi-circular shape having a row of teeth 32 projecting toward and engaging flat undersurface 18 (FIG. 1). Jaw 30 is adapted to pivot away from undersurface 18 (downward as viewed in FIG. 1) about an axle 34 mounted in a suitable pair of opposed bushings 36, 38 extending downwardly for surface 18 and captured in a similar pair of bushings 40, 42 on jaw 30 by a corresponding pair of conventional fasteners 44, 46. Jaw 30 normally is maintained in the position shown in FIG. 1, i.e. with teeth 32 bearing against surface 18, by the action of a spring (not shown) or similar resilient biasing means. A thumb plate 48 extends rearwardly of jaw 30 as shown to provide means for rotating the jaw 30 about axle 34 against the action of the spring into an open position where teeth 32 are displaced from and away surface 18.

In practicing the invention, it will be apparent that a corner or other portion of a blanket, towel, or the like may be securely captured in alligator clip 28 between teeth 32 and undersurface 18 by manipulation and subsequent release of thumb plate 48. The blanket anchor 10 may then be positioned to be inserted into beach sand or soft earth and weight transferred to the head portion 12 thereby driving the stake portion 14 into the ground until the blanket is flush with say, the surface of the sand. The size of head portion 12 is such as to complement the size of the palm of an average adult. Because of its convex shape, a person's weight may comfortably and efficiently be shifted to bear down on the head portion 12 of the blanket anchor of the present invention making penetration of the stake portion into beach sand, soft earth, and the like quite effortless. Once in the ground, the anchor securely and firmly maintains its position. Owing to the tapered design of the stake portion 14, subsequent removal also is quite easily effected by gripping the head portion undersurface 18 with the fingers and lifting upwardly. Alternatively, it will be appreciated that a blanket or other article may be attached to the gripper jaw after the anchor has been driven into the ground.

In accordance with the invention, the blanket anchor 10 is of one-piece construction save for assembly of jaw 30 to undersurface 18. While it is preferred that the blanket anchor be fabricated relatively inexpensively from a rigid, high-strength, molded thermoplastic material, it will be appreciated that other materials may be used instead such as wood, aluminum and the like.

Turning now to FIG. 3-8, an alternative preferred embodiment of the invention will now be described. Like parts will be represented by like reference numerals.

In the prior preferred embodiment, the head portion 12 was elliptically shaped, the stake portion 14 was offset with regard to the central axis of the head portion, and the alligator clip was mounted on the undersurface 18 of the head portion flush with the periphery of the head portion. In contrast, the alternative preferred embodiment of FIGS. 3-8 provides a co-axial arrangement between the stake portion and the head portion, and the alligator clip extends beyond the periphery of the head portion. Thus, turning now to FIGS. 3–5, head portion 12 of blanket anchor 10 has a rounded, convex shape and defines a flat undersurface 18 generally in the shape of a circle. As before, the convex head portion terminates peripherally in an annular surface 16.

Alligator clip assembly 28 for the most part is identical to that described in connection with FIGS. 1–2, but because it extends beyond the head portion it includes an upper plate 50 having a complementary shape to lower jaw 30. Plate 50 is preferably integrally attached to underside 18 at one end and has its other end extending beyond the peripheral surface 16 substantially as shown. Thus, in operating the alligator clip 28 of the alternatively preferred embodiment, pressure against the thumb plate 48 causes the lower jaw 30 to rotate about axle 34 relative to upper jaw plate 50 which remains fixed relative to head portion 12. In all other respects the alligator clip 28 is the same as that described above.

Stake portion 14 in alternatively preferred form comprises a tapered, hollow tube whose central bore or cavity 50 intercepts and opens into the convex surface of head portion 12 thus defining a central receptacle disposed in head portion 12. The inner surface of central bore 52 in the vicinity of convex head portion 12 has formed therein female fastener threads for engaging the complementary male threaded surface 56 of an adapter plug 58 (see FIGS. 6 and 7).

Figure 6:
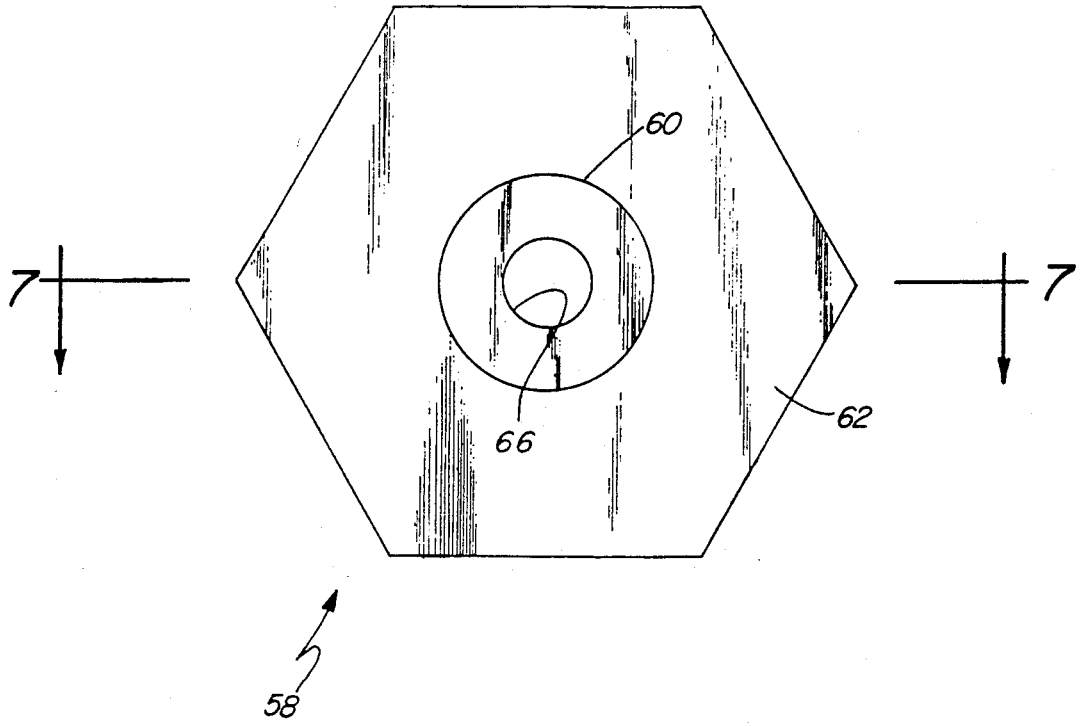
FIG. 6 is a top plan view of an adapter plug used with the embodiment of FIG. 3.
Figure 7:
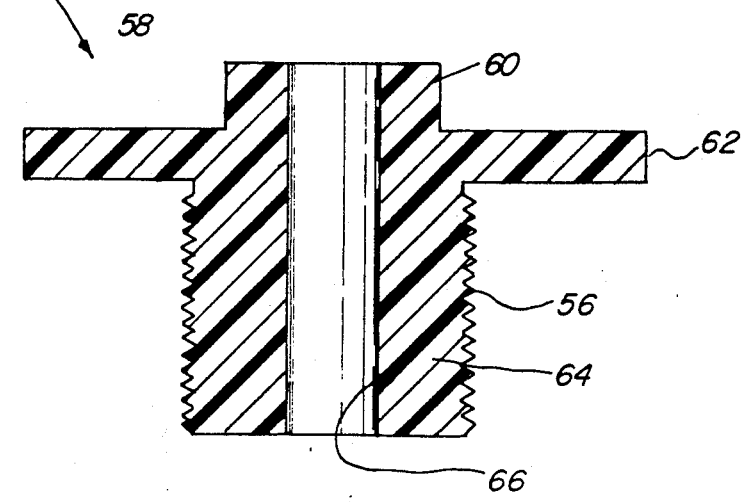
FIG. 7 is a cross-sectional view of the adapter plug of FIG. 6 as viewed along line 7—7 of FIG. 6.
Figure 8:
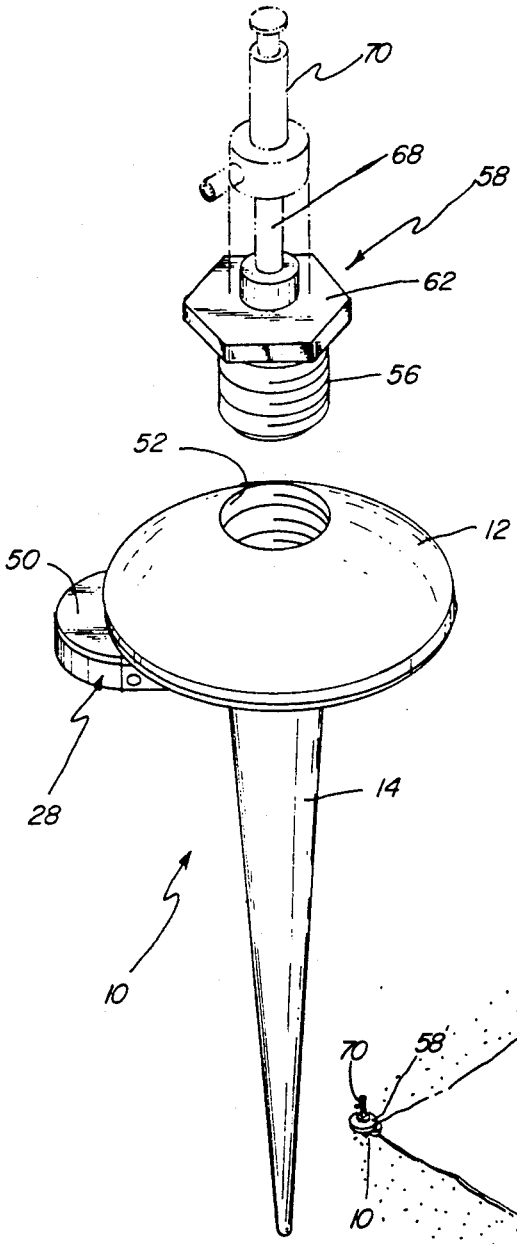
FIG. 8 is a perspective assembly view of the alternative preferred embodiment of the blanket anchor of the invention.

Adapter plug 58 is of one-piece construction and comprises an upper cylindrical portion 60, an intermediate hexagonally shaped wrenching flange 62, and a lower cylindrically shaped extension 64, having disposed on its external surface the aforementioned male threads 56 sized to interfit with the female threaded bore portion 52 in head portion 12. A central bore 66 extends completely through the adapter plug as shown in FIGS. 6 and 7. In accordance with the present invention, adapter plug 58 may be screwed into head portion 12 by inserting the extension 64 into bore portion 52 and rotating the plug into threaded engagement therewith via hexagonal flange 62 until the bottom surface of flange 62 seats on the surface of the head portion surrounding bore portion 52. In this arrangement, the central bore 66 of the adapter plug 58 communicates with the hollow interior of tubular stake 14 and thus forms a receptacle for receivably supporting the extension rod or stem 68 of a hollow tubular dispenser 70 as diagrammatically depicted in FIG. 8. The details of dispenser 70 are outside the scope of the present invention; however, suffice it to say that the dispenser 70 insofar as understanding the principles of the present invention are concerned, serves as a container for a useful product such as suntan lotion, for example. The dispenser includes an extension rod or stem 68 which may be inserted into the receptacle formed by the adapter plug recess 66 and the bore 50 of the hollow tubular stake 14, thus, permitting the blanket anchor of the present invention to serve the dual function as a convenient holder or storage device for useful articles.

Figure 9:
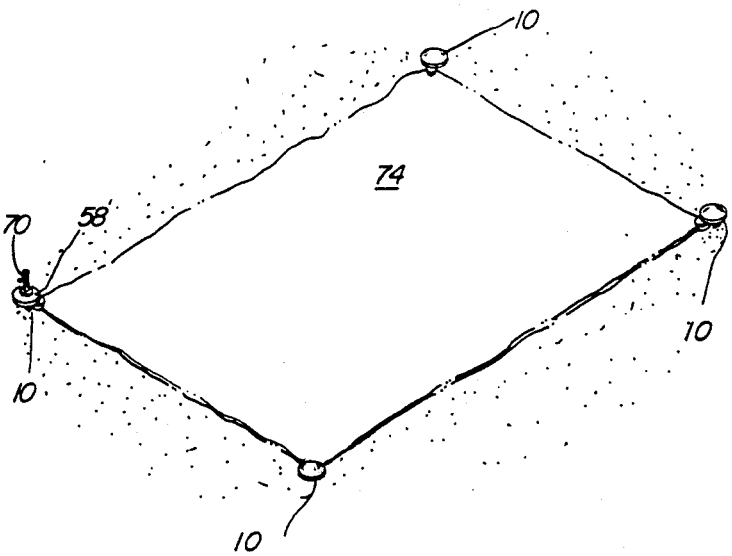
FIG. 9 is a perspective view of the blanket anchor of the invention showing its use in anchoring a blanket.

As shown in FIG. 9, four blanket anchors 10 are employed to anchor the four corners of a beach blanket 74, respectively. In one of the blanket anchors (i.e., the left-most corner), an adapter plug 58 according to the invention is diagrammatically shown in place holding a dispenser 70 for a useful article.

Without limiting the present invention, a blanket anchor of the foregoing description has been successfully used having dimensions as follows: diameter of head portion 12: $2\frac{1}{4}$ inches, height of head portion above flat undersurface 18: $\frac{3}{4}$ inches, length of stake: 6 inches. It will be appreciated however, that these dimensions are merely exemplary and that a wide variation may be utilized.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved anchoring device comprising:

a head portion, a stake portion having a free end depending from said head portion, means associated with said head portion activatable to clamp a portion of an article to be held on a penetrable substance and wherein said head portion has a convex surface for transmitting a force to said stake sufficient to cause said stake free end to penetrate said substance.

wherein said stake portion tapers longitudinally from said head portion toward said free end of said stake portion, wherein said head portion has a flat surface opposed to said convex surface, said stake intercepts said flat surface, and said clamping means is mounted on said flat surface adjacent to said stake portion wherein said stake portion tapers longitudinally from said head portion toward said free end of said stake portion, and wherein said head portion opposed flat surface is circular in shape, said stake portion has a hollow, tapered tube defining an interior cavity, said head portion having a recess disposed in said convex surface, said recess communicating with said interior cavity, and said cavity and said recess being co-axial, further comprising an adapter plug adapted to be removably received within said recess, said adapter plug having a central bore therethrough whereby an article may be inserted through the central bore of said plug and into said interior cavity when said adapter plug is received in said recess.

2. The anchoring device of claim 1 wherein said head portion opposed flat surface is circular in shape, said stake portion is a hollow, tapered tube defining an interior cavity, said head portion having a recess disposed in said convex surface, said recess communicating with said interior cavity, and said cavity and said recess are co-axial.

3. The anchoring device of claim 2 wherein said clamping means comprises a first jaw pivotal with respect to said flat surface, a second jaw in the form of a flat plate extending from said flat surface beyond the peripheral extent of said head portion, and resilient biasing means for maintaining said first jaw in engagement with said second jaw.

4. The anchoring device of claim 1 wherein said adapter plug comprises an externally threaded surface said recess includes an internally threaded surface, and said adapter plug further includes means for causing said threaded surfaces to matingly engage.

5. The anchoring device of claim 4 wherein said means for causing said threaded surfaces to engage comprises a wrenching flange on said adapter plug.

6. The anchoring device of claim 1 wherein said penetrable substance is beach sand or soft earth, and said article is a beach blanket or towel.

7. A new and improved anchoring device comprising:

a head portion, a stake portion having a free end depending from said head portion, and means associated with said head portion activatable to clamp a portion of an article to be held on a penetrable substance, wherein said head portion has a convex surface for transmitting a force to said stake sufficient to cause said stake free end to penetrate said substance and has a flat surface opposed to said convex surface such that said stake intercepts said flat surface, and said clamping means is mounted on said flat surface adjacent to said stake portion, wherein said stake portion tapers longitudinally from said head portion toward said free end of said stake portion and comprises a pair of webs joined to each other, said webs forming a stake portion having a V-shaped transverse cross-section, wherein said head portion opposed flat surface is elliptically shaped and said stake portion having a v-shaped cross-section is offset laterally with respect to the central axis of said head portion, and wherein said clamping means comprises a jaw pivotal with respect to said flat surface, and resilient biasing means for maintaining said jaw in engagement with said flat surface, said clamping means jaw having a peripheral extent coincidental with the peripheral extent of said head portion.

8. The anchoring device of claim 7 wherein said penetrable substance is beach sand or soft earth, and said article is a beach blanket or towel.

* * * * *